US005390738A

United States Patent [19]

Eslinger et al.

[11] Patent Number: 5,390,738

[45] Date of Patent: Feb. 21, 1995

[54] INFLATABLE PACKER INNER BLADDER RETENTION AND SEAL

[75] Inventors: David M. Eslinger, Broken Arrow; Robert M. Sorem, Tulsa, both of Okla.

[73] Assignee: Dowell Schlumberger Incorporated, Houston, Tex.

[21] Appl. No.: 981,712

[22] Filed: Nov. 25, 1992

[51] Int. Cl.[6] ..... E21B 33/127

[52] U.S. Cl. ..... 166/187; 277/34

[58] Field of Search ..... 166/187; 277/34, 34.6

[56] References Cited

U.S. PATENT DOCUMENTS

| | | | |
|---|---|---|---|
| 3,035,639 | 5/1962 | Brown et al. | 166/187 X |
| 3,542,127 | 11/1970 | Malone | 166/122 |
| 3,918,520 | 11/1975 | Hutchinson | 166/64 |
| 4,003,581 | 1/1977 | Hutchinson | 277/34.6 |
| 4,133,386 | 1/1979 | Knox | 166/187 X |
| 4,310,161 | 1/1982 | Streich | 277/34 |
| 4,406,461 | 9/1983 | McGill | 166/187 X |
| 4,892,144 | 1/1990 | Coone | 166/122 |
| 5,205,567 | 4/1993 | Quinlan et al. | 166/187 X |

FOREIGN PATENT DOCUMENTS

| | | | |
|---|---|---|---|
| 2443094 | 3/1976 | Germany | 166/187 |

*Primary Examiner*—Hoang C. Dang
*Attorney, Agent, or Firm*—S. A. Littlefield

[57] ABSTRACT

Bladder retention for an inflatable packer includes a tubular base and a retainer member. Retainer teeth are provided on both the tubular base and the retainer member to retain the bladder against the axial loads of inflation. Separate sealing ribs are provided on at least one of the tubular base and retainer member which positively engage a portion of the bladder which is not subjected to longitudinal stresses due to its location outwardly of the retainer teeth. Additionally, an elastomeric o-ring seal is provided between the retainer member and the tubular base thereby blocking the application of pressure forces tending to disengage the elastomeric bladder from its retention assembly.

2 Claims, 2 Drawing Sheets

INFLATABLE PACKER INNER BLADDER RETENTION AND SEAL

This invention relates to the art of production of subterranean fluid through a wellbore and more particularly, to an inflatable packer or bridge plug useful in temporarily isolating portions of a wellbore.

BACKGROUND OF THE INVENTION

Inflatable packers or bridge plugs have long been used in wellbore operations. An inflatable packer typically comprises a tubular base and a surrounding, inflatable elastomeric bladder or sleeve. Fluid passages within the tubular body allow fluids to contact the inflatable bladder and expand the bladder radially outwardly to effect sealing engagement with a borehole or well casing.

Since the elastomeric bladder is subjected to both expansion pressure and abrasion or cutting forces, it has been common to surround the exterior surface of the bladder with a plurality of peripherally overlapping, resilient reinforcing slats or ribs. There is generally sufficient overlap of such slats that upon expansion of the inflatable bladder, the slats remain as a surrounding armor protecting the bladder from abrasion and cuts while also preventing extrusion of the bladder elastomer between the slats in a localized area.

Because the slats cannot effect the sealing of the packer against a wellbore or casing, at least some portions of the reinforcing slats are surrounded by and may be bonded to an outer annular elastomeric cover or packing element which, upon expansion of the inflatable packer, comes into pressure sealing engagement with the wellbore or casing.

The outer sealing cover generally comprises either a single or a plurality of annular circumferential elastomeric pieces located on the outer surface of the reinforcing slats. When a single elastomeric piece is employed it may cover only a portion of the longitudinal length of the slats or, alternatively, it may cover the entire outer surface of the slats. Such single piece covers generally have a uniform thickness along their length, the thickness generally being substantial.

In a typical inflatable packer, the bladder is retained between two metal elements of an end fitting, one abutting the inner cylindrical surface of the bladder and the other abutting the outer cylindrical surface of the bladder. The bladder is held in compression between these metal elements. Additionally, one or both of these metal elements may be provided with circumferential ribs or teeth which act to further retain the bladder in position and resist expansion stresses which would tend to pull the bladder out from between the compressive grip of the retainer elements. These types of assembly are shown in U.S. Pat. Nos. 3,918,520, 3,542,127, 4,003,581 and 4,892,144.

One additional force tending to work against bladder retention is not considered in prior art designs. Typically, the end edges of the bladder are subjected to pressure forces exerted by the inflation fluid used to expand the bladder. This additional pressure acts to push the end of the bladder out of its retaining assembly and, when added to the expansion stresses pulling on the bladder within its retention system, results in a common cause of failure of the bladder to retain pressure.

SUMMARY OF THE INVENTION

The present invention is directed to avoiding the application of pressure to the end portions of the bladder within its retainer assembly.

In accordance with the invention, an inflatable packer including a tubular base portion, an inflatable elastomeric bladder and retainer members compressing end portions of the bladder against adjacent portions of the tubular base further includes an elastomeric o-ring seal extending between the retainer member and the tubular base longitudinally outwardly of the end portion of the elastomeric bladder.

It is therefore an object of this invention to provide a means for sealing against the action of inflation pressures which would tend to push end portions of an inflatable bladder out of its retainer assembly during use.

BRIEF DESCRIPTION OF THE DRAWINGS

These and other objects of the invention will be described hereinafter in conjunction with the accompanying drawings forming a part of this specification and in which.

DETAILED DESCRIPTION OF THE PREFERRED EMBODIMENTS AND DRAWINGS

Figure 1:
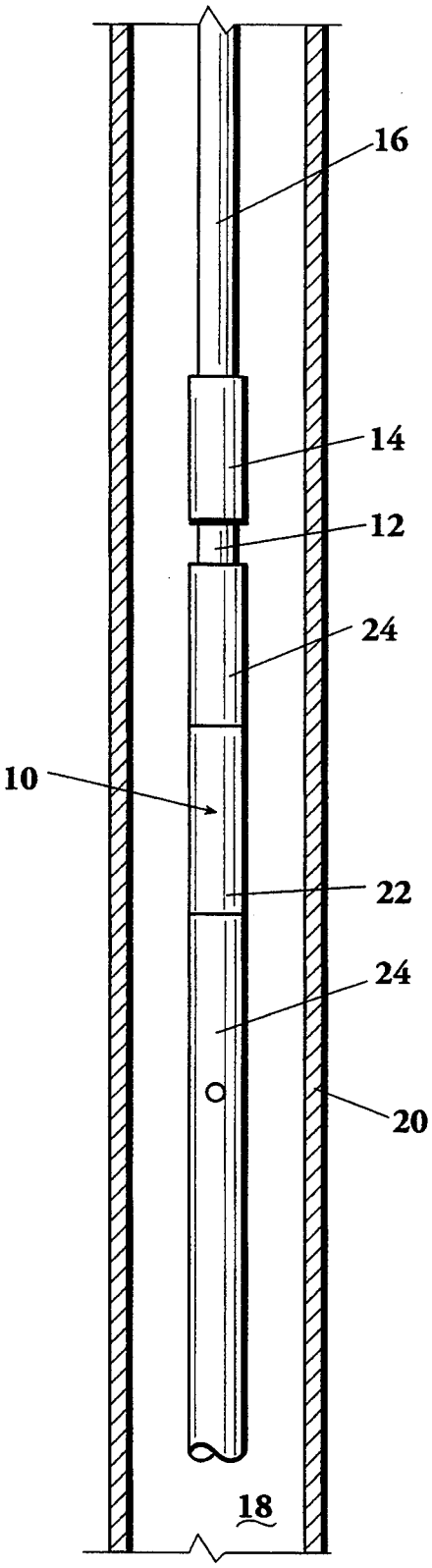
FIG. 1 is a schematic view of an inflatable packer in use prior to inflation.

Referring now to the drawings, wherein the showings are for the purposes of illustrating the preferred embodiment of the invention only and not for the purposes of limiting same, FIG. 1 schematically illustrates the inflatable packer device in its run-in condition prior to inflation. It will be understood that the inflatable packer may be one packing element of a bridge plug or only a single packer employed to isolate one part of a wellbore from another. The packer element 10 includes a tubular base portion 12 and is interconnected with a coupling number 14 to a tubular string 16 extending to the surface. It will be appreciated that the tubular string 16 can be formed by coupling individual sections of pipe or, in a preferred embodiment of the invention, a continuous length of coiled tubing inserted into the wellbore 18 having a casing 20.

The packer element 10 generally comprises an inflatable portion 22 with at least one and possibly two associated end fittings 24. It will be further understood that the inflatable packer may be associated with one or more downhole tools such as to effect the injection of various fluids into isolated portions of the wellbore 18.

Figure 2:
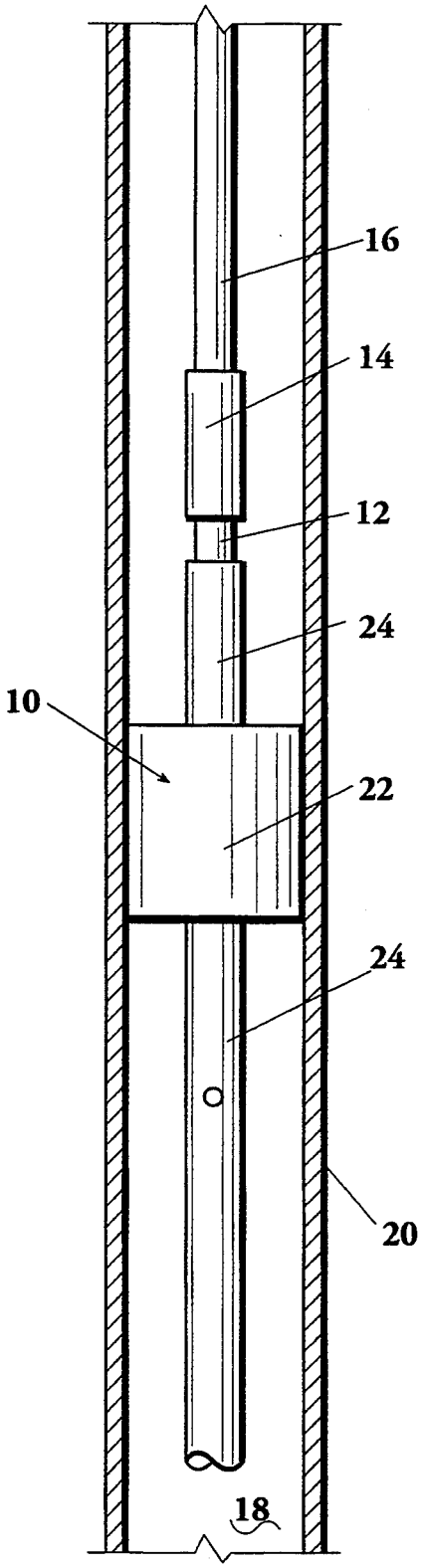
FIG. 2 is a schematic view similar to FIG. 1 showing the inflatable packer in the inflated condition.

At the point desired in the wellbore, the inflatable portion 22 of the packer element 10 is expanded through the application of fluid pressure to the interior of the inflatable portion and expanded outwardly into engagement with the casing 20 (FIG. 2). It will be understood that while the use of the inflatable packer of the present invention is shown in conjunction with a cased borehole, the inflatable packer may also be used in an uncased wellbore under appropriate conditions known to those skilled in the art.

Figure 3:
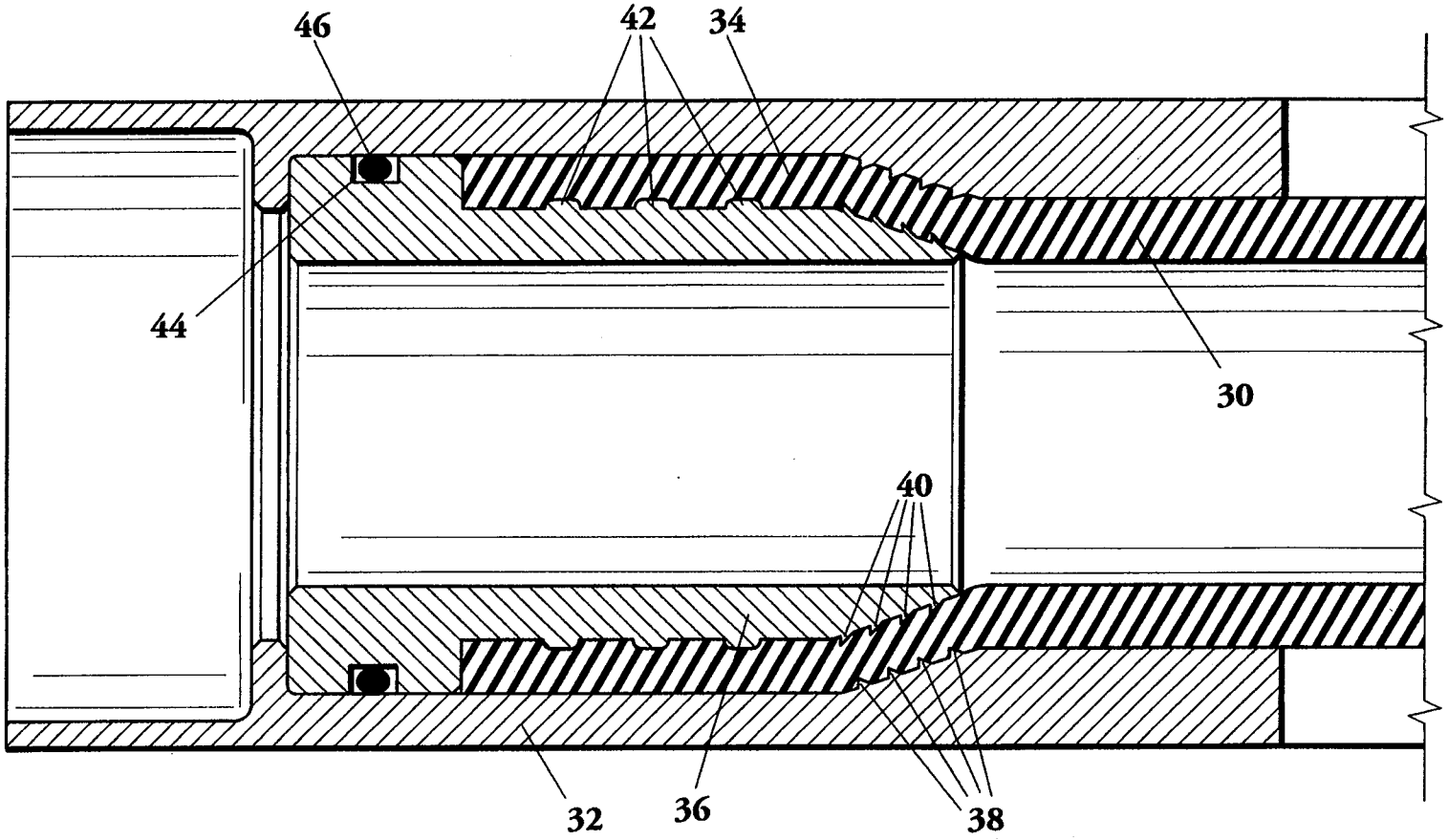
FIG. 3 is a cross-sectional elevation showing the inner bladder retention and seal assembly in accordance with the present invention.

FIG. 3 illustrates the preferred retention of the bladder in accordance with the invention. The bladder 30 extends longitudinally in a tubular base 32. An end portion 34 of the bladder 30 is retained within the tubular base 32 by a retainer member 36, the end portion 34 of the bladder 30 being retained in compression between the retainer member 36 and the tubular base 32.

As shown in the figure, both the tubular base 32 and the retainer member 36 include radially oriented teeth 38 and 40, respectively, which act to further retain the end portion 34 of the bladder 30. Additionally, the retainer member 36 incorporates a series of radially extending ribs 42 which further effect retention of the bladder 30.

In accordance with the invention, the retainer member 36 also incorporates a circumferential groove 44 longitudinally outwardly of the end portion 34 of the bladder 30. An elastomeric o-ring seal member 46 is located within the groove 44 and is in sealing engagement with the tubular base 32. It will be understood that while the groove and o-ring are shown in conjunction with a retainer member, it would also be possible to employ a groove and o-ring associated with the tubular base similarly effecting the desired seal between the retainer member 36 and the tubular base 32.

It can be seen that inflation pressure within the tubular base 32 and the bladder 30 are blocked by the elastomeric o-ring seal member 46 from acting against the end portion 34 of the bladder 30 thereby avoiding additional pressure forces tending to disengage the end portion 34 from the retainer assembly.

While the invention has been described in the more limited aspects of a preferred embodiment thereof, other embodiments have been suggested and still will others will occur to those skilled in the art upon a reading and understanding of the foregoing specification. It is intended that all such embodiments be included within the scope of this invention as limited only by the appended claims.

Having just described our invention, we claim:

1. An inflatable packer including a tubular base; an elastomeric bladder having an end portion and an inner and an outer surface, a portion of said outer surface of said bladder being in engagement with an inner bore surface of said tubular base; a retainer member having an outer surface in engagement with a portion of said inner surface of said bladder adjacent to portion of said outer surface; an elastomeric o-ring seal extending between said tubular base and said retainer member longitudinally outwardly of said bladder end portion; at least one radially extending rib located on at least one of said retainer member and said tubular member in compressive engagement with said adjacent portion of said elastomeric bladder and a plurality of radially extending teeth on both said tubular base and said retainer member longitudinally separated from said end portion of said bladder and from said at least one radially extending rib.

2. The inflatable packer as set forth in claim 1 wherein a plurality of radially extending ribs are located on both said retainer member and said tubular member.

* * * * *